US005950388A

United States Patent [19]

Jaklin

[11] Patent Number: 5,950,388

[45] Date of Patent: Sep. 14, 1999

[54] PLATE FOR FLOORING

[75] Inventor: Bjorn Jaklin, Oslo, Norway

[73] Assignee: Brodrene Furst AS, Oslo, Norway

[21] Appl. No.: 08/981,195

[22] PCT Filed: May 28, 1996

[86] PCT No.: PCT/NO96/00130

§ 371 Date: Mar. 4, 1998

§ 102(e) Date: Mar. 4, 1998

[87] PCT Pub. No.: WO97/00364

PCT Pub. Date: Jan. 3, 1997

[30] Foreign Application Priority Data

Jun. 14, 1995 [NO] Norway ..... 952349

[51] Int. Cl.[6] ..... E04B 5/00

[52] U.S. Cl. ..... 52/578; 52/592.1; 52/590.2; 52/586.1

[58] Field of Search ..... 52/586.1, 592.1, 52/592.2, 591.1, 590.2, 578, 591.2, 591.3; 446/124, 125; 403/364; 256/24, 19; 472/92; 404/35, 36; 473/115, 117

[56] References Cited

U.S. PATENT DOCUMENTS

| | | | |
|---|---|---|---|
| 2,256,836 | 9/1941 | Potchen | 52/591.1 |
| 3,657,852 | 4/1972 | Worthington et al. | 52/591 |
| 3,895,148 | 7/1975 | Chang | 52/591.2 |
| 3,902,293 | 9/1975 | Witt et al. . | |

FOREIGN PATENT DOCUMENTS

| | | | |
|---|---|---|---|
| 2657104 | 7/1991 | France | 52/578 |
| 1509698 | 5/1969 | Germany . | |
| 4235146 | 4/1994 | Germany . | |
| 982775 | 2/1965 | United Kingdom | 52/578 |
| WO 94/01628 | 1/1994 | WIPO | 52/578 |
| 9514834 | 6/1995 | WIPO . | |

*Primary Examiner*—Carl D. Friedman
*Assistant Examiner*—Dennis L. Dorsey
*Attorney, Agent, or Firm*—Ladas & Parry

[57] ABSTRACT

A plate for flooring which easily may be laid out and taken up, e.g. for temporary covering of artificial grass indoors in gymnasiums, has rectangular form and comprises longitudinal; edges having upper lips and lower lips. The upper and lower lips are arranged sectionwise so that the longitudinal edges generally exhibit one upper lip on a section where their is no lower lip and vice versa, and that on the or those sections where one of the longitudinal edges has an upper lip the other longitudinal edge has a lower lip and vice versa.

20 Claims, 5 Drawing Sheets

PLATE FOR FLOORING

This application is a 371 of PCT/NO96/00130 filed on May 28, 1996.

The present application relates to a plate for flooring which easily may be laid out and taken up, e.g. for temporary covering of artificial grass indoors in gymnasiums, said plate having rectangular form and comprising longitudinal edges having upper lips and lower lips.

Such plates, which e.g. may have a size of 1, 5×3 m, are often laid out in bond and are connected to the adjacent plates at their short and longitudinal edges, e.g. by means of a tongue and groove principle and/or more or less loose pins arranged in bores in the edge surfaces. It is also known to use external fittings in order to keep the plates in place with respect to each other. DE 38 26 307 shows examples of different ways of interconnecting the plates.

Common to the prior art solutions is that they are not able to combine the possibility of permitting quick and exact laying out and a resulting steady and stable floor where the joints do not form cracks and stumbling edges, particularly when the plates are subject to point loading of some magnitude.

The object of the present invention is to improve this situation. This is obtained according to the invention by a plate of the type mentioned in the introductory paragraph, which is characterized in that the upper and lower lips are arranged sectionwise such that the longitudinal edges generally exhibit an upper lip on a section where there is no lower lip, and vice versa, and that on the or those sections where one longitudinal edge exhibits an upper lip, the other longitudinal edge has a lower lip, and vice versa.

Further advantageous features of the invention are recited in the dependent claims.

Figure 1:
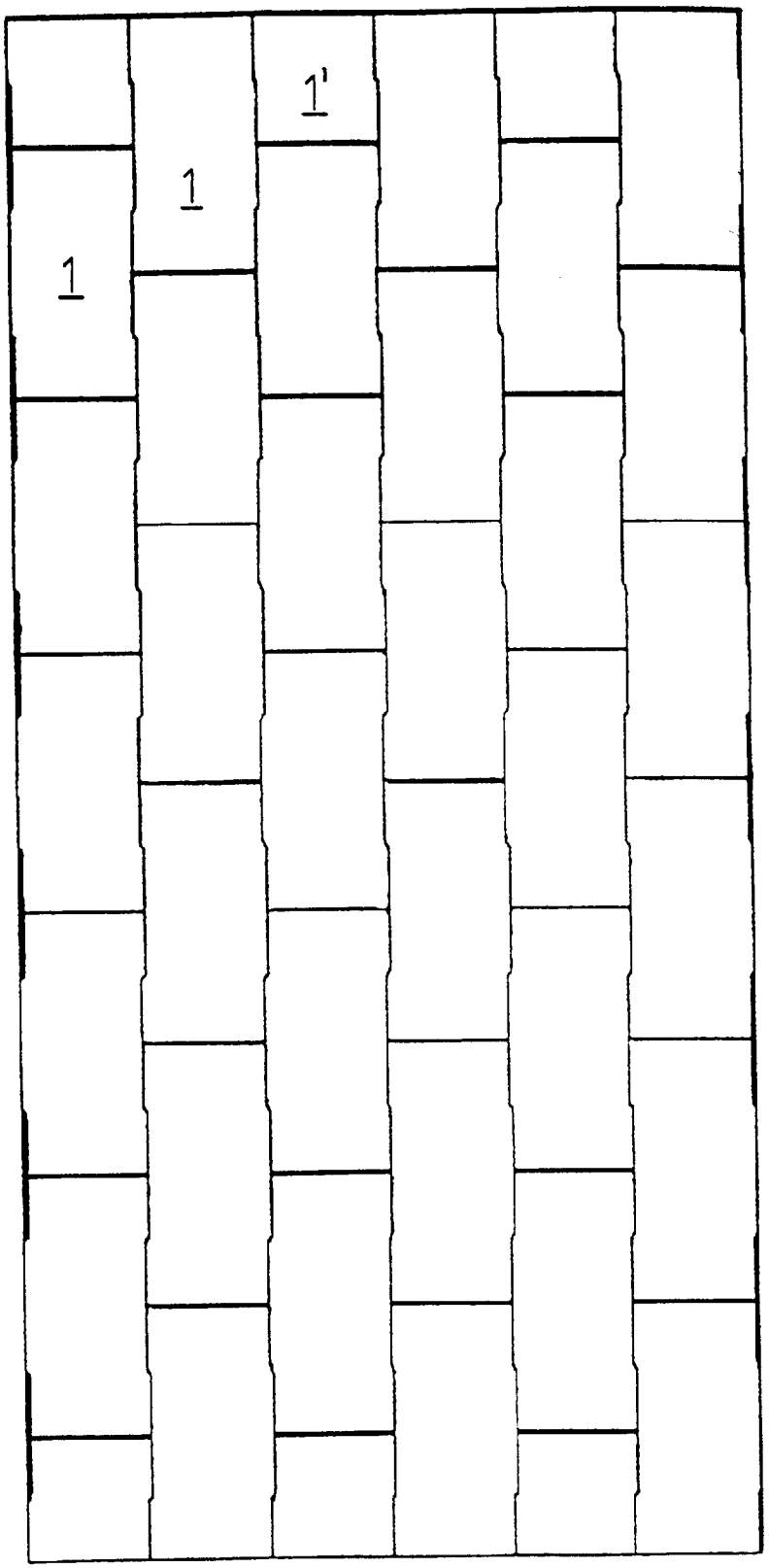
Figure 2:
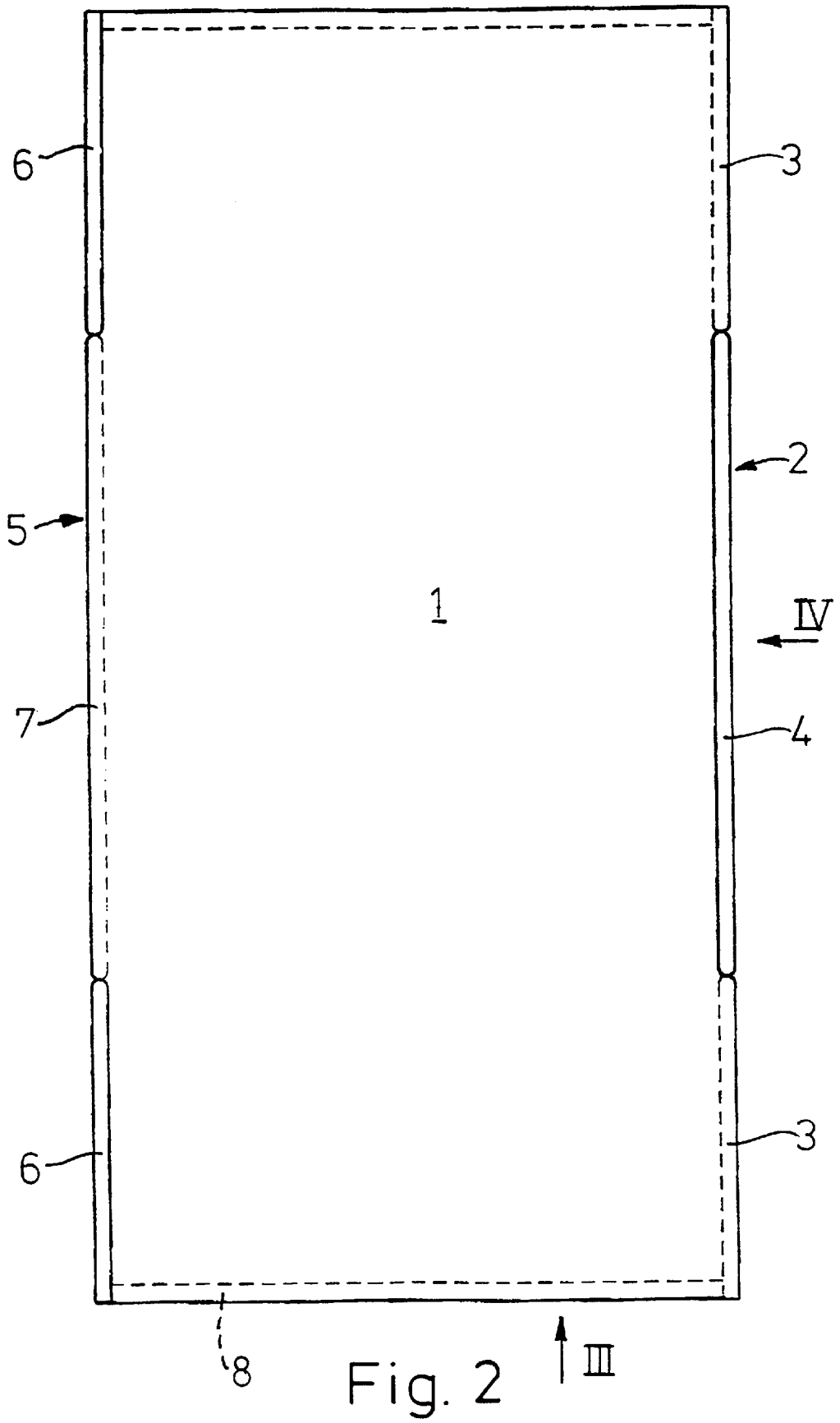
Figure 3:
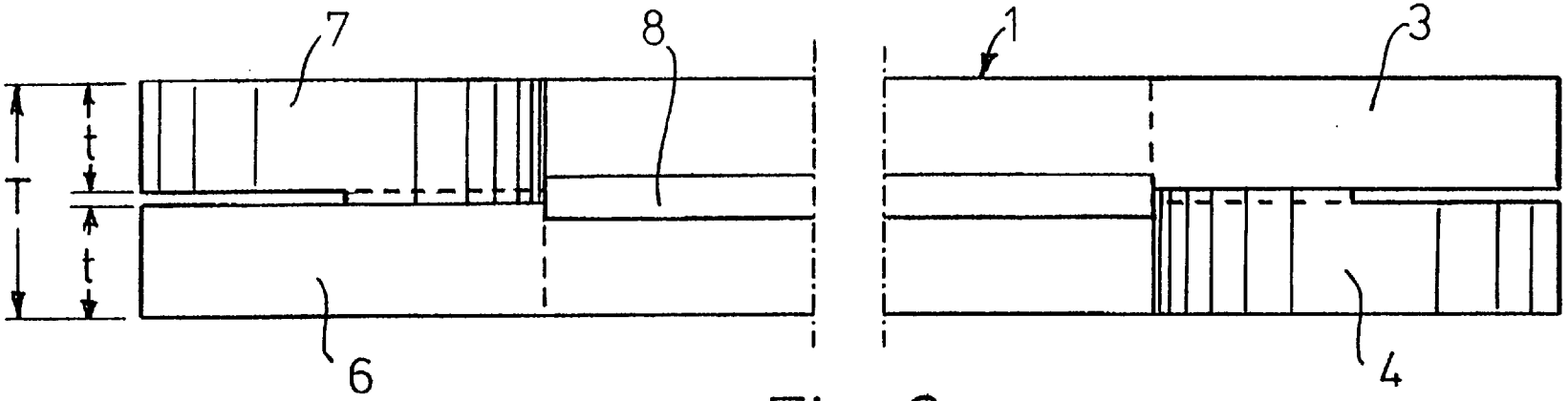
Figure 4:
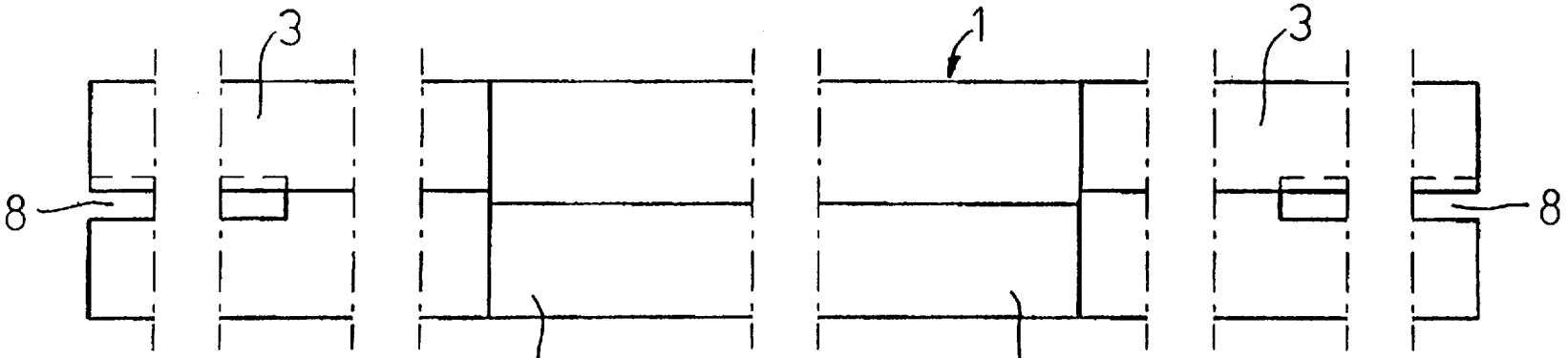
Figure 5:
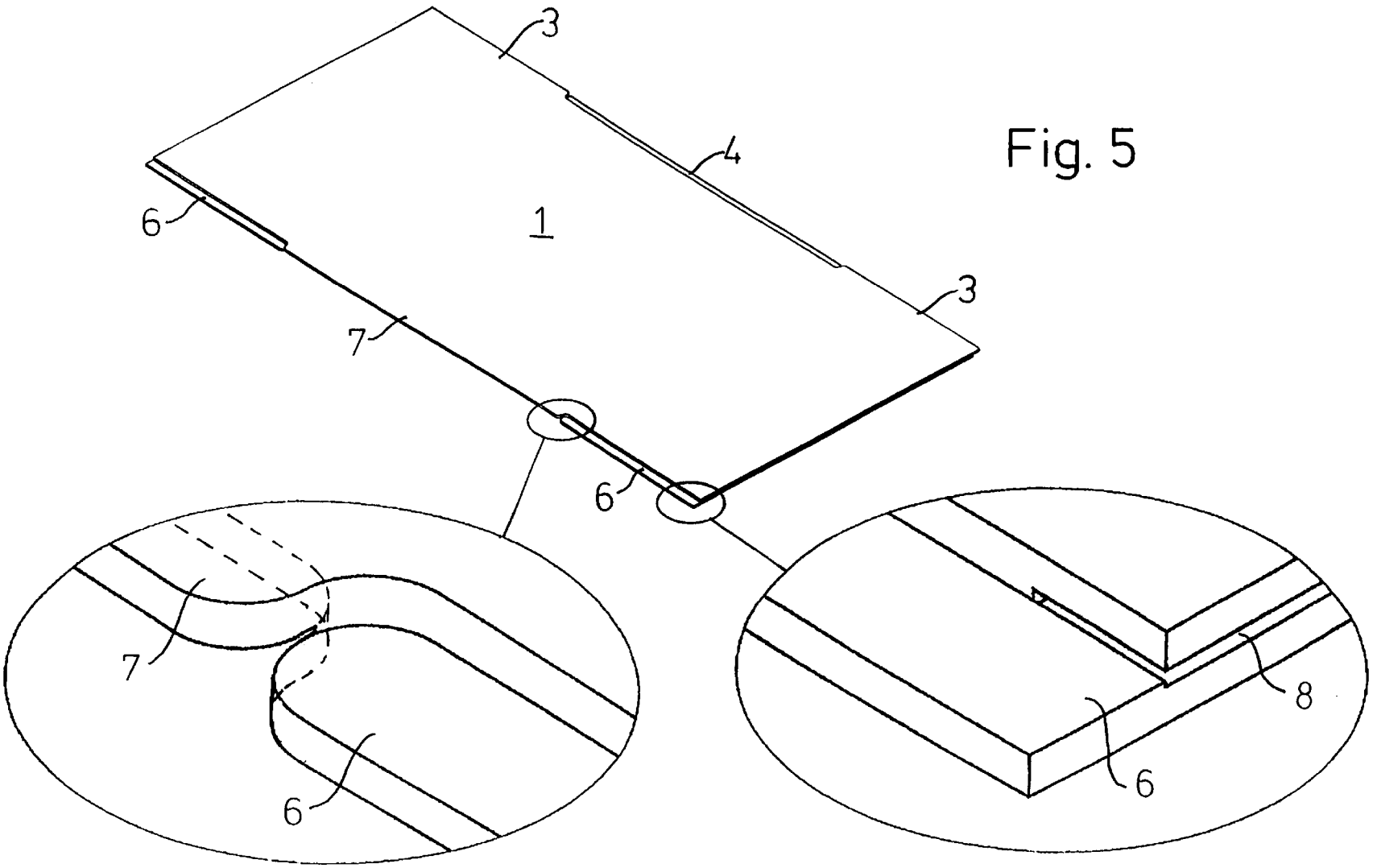
Figure 6:
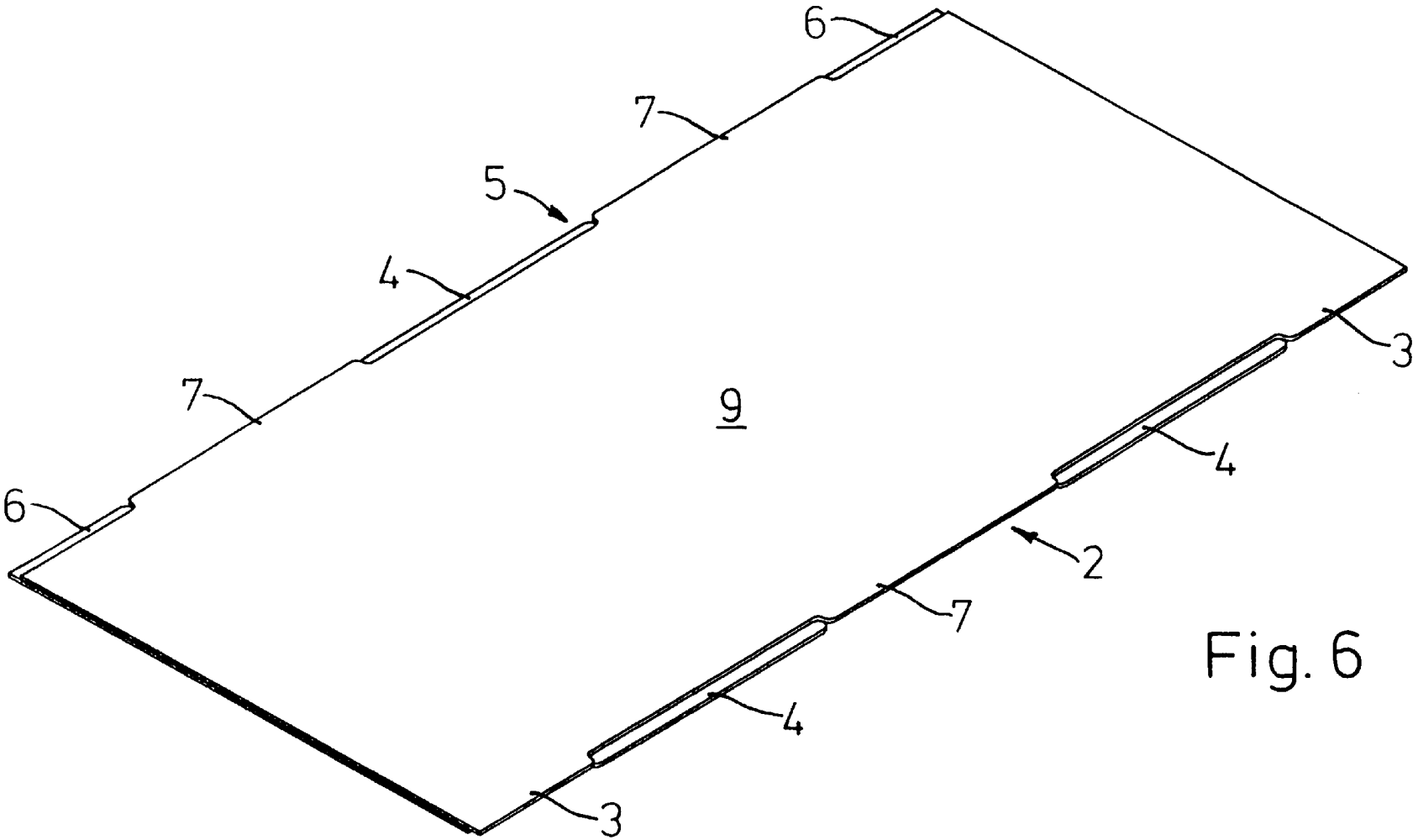

For better understanding of the invention it will be described more closely with reference to the exemplifying embodiments shown in the appendant drawings, where:

FIG. 1 is a schematic plan view of a floor, provided with plates according to the invention, FIG. 2 is an elevation of a single plate used in the floor in FIG. 1, FIG. 3 is an edge view, seen in the direction of the arrow III in FIG. 2, FIG. 4 is an edge view, seen in the direction of the arrow IV in FIG. 2, FIG. 5 is a perspective view of the plate in FIG. 1, with two segments shown at a larger scale, and FIG. 6 is a perspective view of an alternate embodiment of the plate according to the invention.

The floor shown in FIG. 1 is covered by several rows of plates 1, said rows being shifted one half plate length with respect to each other such that the plates are lying in bond. The plates in every other row is turned 180° about a vertical axis in order to fit together with the plates in the adjacent rows. At their ends, some of the rows have been completed by half plates 1'.

The particular design of the plates 1 will appear from FIGS. 2–5. FIG. 2 shows the plate seen from above, and the right longitudinal edge 2 is here provided with two short so-called upper lips 3 and an intermediate long lower lip 4. The left longitudinal edge 5 is conversely provided with two short lower lips 6 and one long upper lip 7. The short sides of the plate 1 are provided with a groove 8 which extends all the way out to the bottom of the lips, as shown most clearly in FIGS. 3 and 5.

Furthermore, FIG. 3 shows the relationship between the thickness T of the plate 1 and the thickness t of the upper and lower lips. The thickness t of the lips is preferably from 40% to 49% of the thickness T of the plates, preferably between 46% and 48% thereof. In order to give the plate optimum strength and stability in relation to the price, it is suggested to make it from plywood. The plate may have a nominal length of 240 cm and a width of 120 cm, while the plate thickness T advantageously may be 18 mm. With this plate thickness, the lip thickness t may be 8,5 mm, thus forming a virtual clearance of 1 mm between the upper and lower lips when these are viewed in the direction of the arrow III in FIG. 2. This clearance facilitates the joining of the plates when they are not absolutely flat or when the substructure is not even, but the "clearance" must not be large enough to permit the difference in level between to adjacent plates from becoming so large that a stumbling edge results in the joint. The above mentioned ranges for the thickness relationship between plate and lips provide a good compromise in this respect.

In the groove 8, which in cross-section is shown in FIG. 4, a loose tongue is placed during the laying of the plates, said tongue extending sufficiently far out of the groove 8 to cooperate with the corresponding groove 8 in the next plate to be laid. The length of this loose tongue must at least be so much shorter than the groove 8 as the width of the tongue so that the plate, after first being pushed with its short side to abutment against the short side of the previously laid neighbouring plate, may be pushed transversally of its longitudinal direction in order for the lips on the longitudinal edge to mesh with the adjacent plate. It will be understood that the loose tongue may consist of several parts.

FIG. 5 illustrates the rounding of the end terminations of the upper and lower lips not coinciding with the terminations of the longitudinal edges. This minimizes the number of sharp corners, which are more easily broken or damaged in other ways by handling of the plates and, furthermore, provides advantages in the manufacturing of the plates. Besides, the rounded edges provide a guiding effect when the plates are joined.

In FIG. 6 an alternative design is represented by a plate 9, which may have the same outer dimensions as the plate 1. Here, however, the longitudinal edge 2 has three upper lips and two lower lips, while the other longitudinal edge 5 is provided with three lower lips and two upper lips in a complementary manner. This design has the advantage that the plates in every second plate row (FIG. 1) do not have to be turned 180° with respect to the other plates. Furthermore, the shorter lips may provide a more stable joint when the plates are subjected to e.g. heavier point loads or moisture.

It may be seen that while the plate 1 has three lips along each longitudinal edge, the plate 9 has five lips, i.e. in both cases an odd number. Also plates having a larger odd number of lips may be used in a similar fashion. Furthermore, it will be understood that for both the plates the upper lips and lower lips will be symmetrically arranged about a plane perpendicular to the plate and its longitudinal edges and extending through the mid-point of the plate. Besides, the plates are symmetrical about a longitudinal central axis.

I claim:

1. A plate for flooring which easily may be laid out and taken up, for temporary covering of artificial grass indoors in gymnasiums, said plate having rectangular form and comprising; longitudinal edges having upper lips and lower lips, wherein the upper and lower lips are arranged sectionwise such that the longitudinal edges generally exhibit an upper lip on a section where there is no lower lip, and vice versa, and that on those sections where one longitudinal edge exhibits an upper lip, the other longitudinal edge has a lower lip, and vice versa; and short edges, wherein said short edges are provided with a groove, said groove being suitable for receiving part of a loose tongue, with another part of said tongue being receivable in a corresponding groove in an adjacent plate.

2. A plate according to claim 1, wherein said sections are half as long at the ends of the longitudinal edges as along the remainder of the longitudinal edges.

3. A plate according to claim 1, wherein one of the longitudinal edges has two upper lips and one lower lip which is substantially as long as the two upper lips together.

4. A plate according to claim 1, wherein one of the longitudinal edges of the plate has three upper lips and two lower lips, the middle upper lip and the two lower lips being generally twice as long as the two remaining upper lips.

5. A plate according to claim 1, wherein each longitudinal edge has an odd number of lips.

6. A plate according to claim 1, wherein it is symmetrical about a longitudinal central axis.

7. A plate according to claim 1, wherein it is made of plywood.

8. A plate according to claim 1, wherein the thickness of the lips is between 40% and 49% of the thickness of the plate.

9. A plate according to claim 1, wherein the upper and lower lips are arranged symmetrically about a plane perpendicular to the plate and its longitudinal edges and extending through the mid-point of the plate.

10. A plate according to claim 9, wherein the end terminations of the upper and lower lips which do not coincide with the terminations of the longitudinal edges, are rounded.

11. A plate according to claim 9, wherein said sections are half as long at the ends of the longitudinal edges as along the remainder of the longitudinal edges.

12. A plate according to claim 9, wherein one of the longitudinal edges has two upper lips and one lower lip which is substantially as long as the two upper lips together.

13. A plate according to claim 9, wherein one of the longitudinal edges of the plate has three upper lips and two lower lips, the middle upper lip and the two lower lips being generally twice as long as the two remaining upper lips.

14. A plate according to claim 9, wherein each longitudinal edge has an odd number of lips.

15. A plate according to claim 9, wherein it is symmetrical about a longitudinal central axis.

16. A plate according to claim 9, wherein it is made of plywood.

17. A plate according to claim 9, wherein the thickness of the lips is between 46% and 48% of the thickness of the plate.

18. A plate according to claim 1, wherein the end terminations of the upper and lower lips which do not coincide with the terminations of the longitudinal edges, are rounded.

19. A plate according to claim 18, wherein each longitudinal edge has an odd number of lips.

20. A plate according to claim 18, wherein it is symmetrical about a longitudinal central axis.

* * * * *